US008197264B1

(12) United States Patent
Eakins et al.

(10) Patent No.: US 8,197,264 B1
(45) Date of Patent: Jun. 12, 2012

(54) ELECTRICAL CONNECTOR

(75) Inventors: Bert William Eakins, Groveland Township, MI (US); George E. Fox, Maybee, MI (US); Thomas D. Belanger, Jr., New Hudson, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 13/038,528

(22) Filed: Mar. 2, 2011

(51) Int. Cl.
*H01R 12/00* (2006.01)

(52) U.S. Cl. ..... 439/83; 439/592

(58) Field of Classification Search ..... 439/83, 439/592, 487, 876, 593, 485
See application file for complete search history.

(56) References Cited

U.S. PATENT DOCUMENTS

| | | | | |
|---|---|---|---|---|
| 5,334,059 | A | 8/1994 | Seidler | |
| 5,535,513 | A * | 7/1996 | Frantz | 29/882 |
| 5,746,608 | A * | 5/1998 | Taylor | 439/70 |
| 5,919,049 | A | 7/1999 | Petersen et al. | |
| 6,475,027 | B1 | 11/2002 | Boldt et al. | |
| 6,644,985 | B2 * | 11/2003 | Wilson et al. | 439/83 |
| 7,458,828 | B2 | 12/2008 | Pavlovic | |
| 2002/0177334 | A1 | 11/2002 | Akama et al. | |
| 2005/0020108 | A1 | 1/2005 | Ju | |
| 2005/0064745 | A1 | 3/2005 | Zhang | |
| 2005/0245121 | A1 | 11/2005 | Lin | |
| 2010/0144172 | A1 | 6/2010 | Pavlovic | |

FOREIGN PATENT DOCUMENTS

| | | | |
|---|---|---|---|
| WO | 2008017717 | A1 | 2/2008 |

* cited by examiner

*Primary Examiner* — Gary F. Paumen
(74) *Attorney, Agent, or Firm* — Brooks Kushman P.C.

(57) ABSTRACT

The connector assembly includes a body extending along a length with a longitudinal height defined by a first surface and an opposing second surface. At least one terminal projects through the body. The terminal includes a blade extending from the first surface for electrically connecting with a mating connector. The terminal also includes a leg extending from the second surface. A tab has a convex surface and is formed at a distal end of the leg without any apertures formed therethrough. The convex surface is adapted for electrically connecting with a mounting surface of an electronic component upon receipt of a predetermined signal.

20 Claims, 4 Drawing Sheets

ELECTRICAL CONNECTOR

TECHNICAL FIELD

One or more embodiments relate to an electrical connector assembly, and a method for attaching the electrical connector assembly to a circuit board.

BACKGROUND

One example of an electrical connector is disclosed in U.S. Pat. No. 7,458,828 to Pavlovic.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
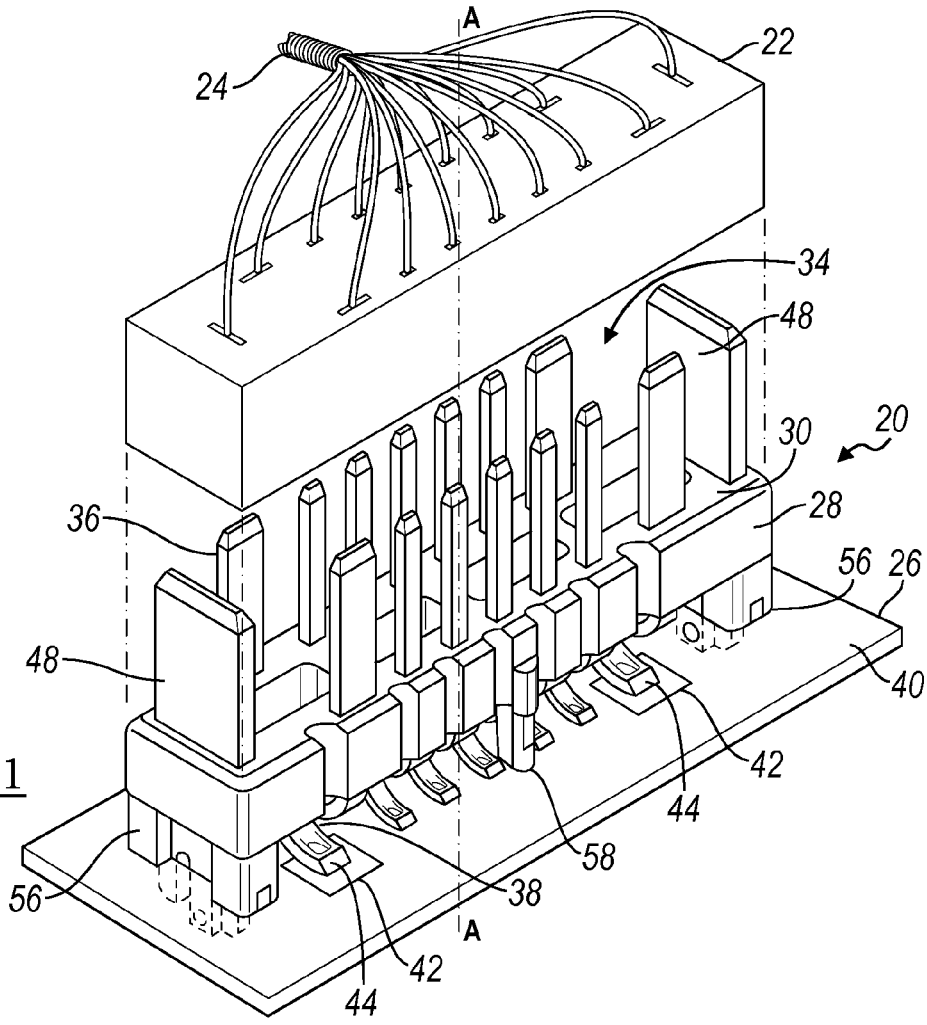
FIG. 1 is a top perspective view of an electrical connector assembly according to at least one embodiment, illustrated with an in-line connector and a circuit board.

With reference to FIG. 1, an electrical connector assembly is illustrated in accordance with an embodiment and is generally referenced by numeral 20. The connector assembly 20 connects a mating in-line connector 22 attached to a wire harness 24, with a circuit board 26. In general, the connector assembly 20 is provided having surface mount terminals configured for maintaining the electrical connection to the circuit board 26, and for dissipating excess heat.

The connector assembly 20 includes a body 28 having a generally rectangular shape. The body 28 extends along a length and has a longitudinal height defined by a first surface 30 and an opposing second surface 32. The body 28 is formed of an electrically insulating polymeric material.

The connector assembly 20 includes a series of surface mount terminals 34 that project through the body 28. Each terminal 34 includes a blade 36 and a leg 38. Each blade 36 extends from the first surface 30 of the body 28 for electrically connecting with a female terminal (not shown) retained in the in-line connector 22. The in-line connector 22 translates about a longitudinal axis of insertion A-A to connect with the connector assembly 20.

Each leg 38 extends from the second surface 32 and attaches to a mounting surface 40 of the circuit board 26. The circuit board 26 may include conductive pads 42 that are disposed on the mounting surface 40 for external access. Other conductive leads (not shown) may be disposed beneath the mounting surface 40. A tab 44 is formed at a distal end of the leg 38. The tab 44 is attached, (e.g., soldered) to a corresponding pad 42 for electrically connecting with the circuit board 26. For brevity, only two pads 42 are illustrated in FIG. 1, however the circuit board 26 includes a pad 42 or other conductive surface for electrically connecting with each tab 44.

The connector assembly 20 may also include through-hole terminals 48. Through-hole terminals 48 extend through the circuit board 26. In the illustrated embodiment, the connector assembly 20 includes two through-hole terminals 48 projecting through end portions of the body 28. Through-hole terminals 48 may be used to locate the connector assembly 20 on the circuit board 26, before the surface mount terminals 34 are soldered in place.

Figure 2:
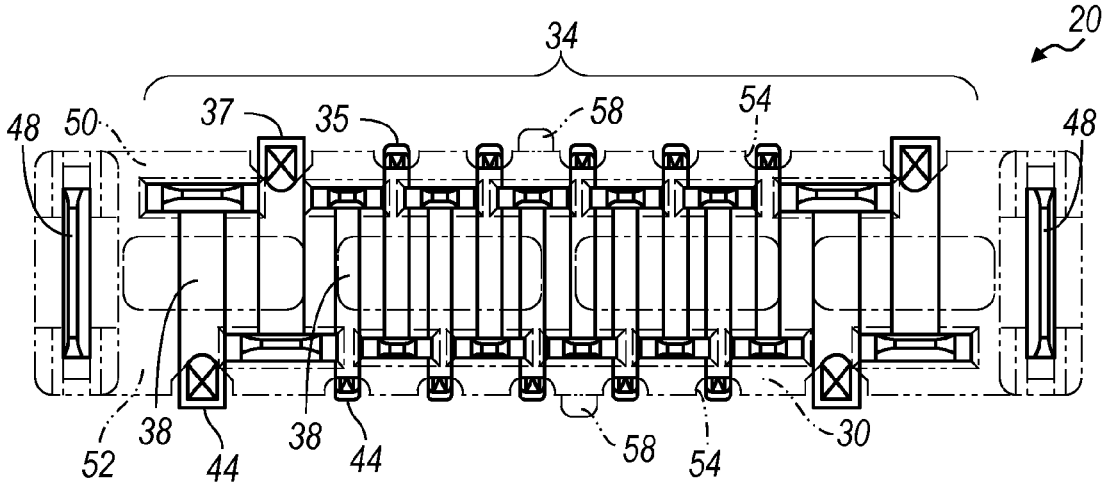
FIG. 2 is a top plan view of the electrical connector assembly of FIG. 1.
Figure 3:
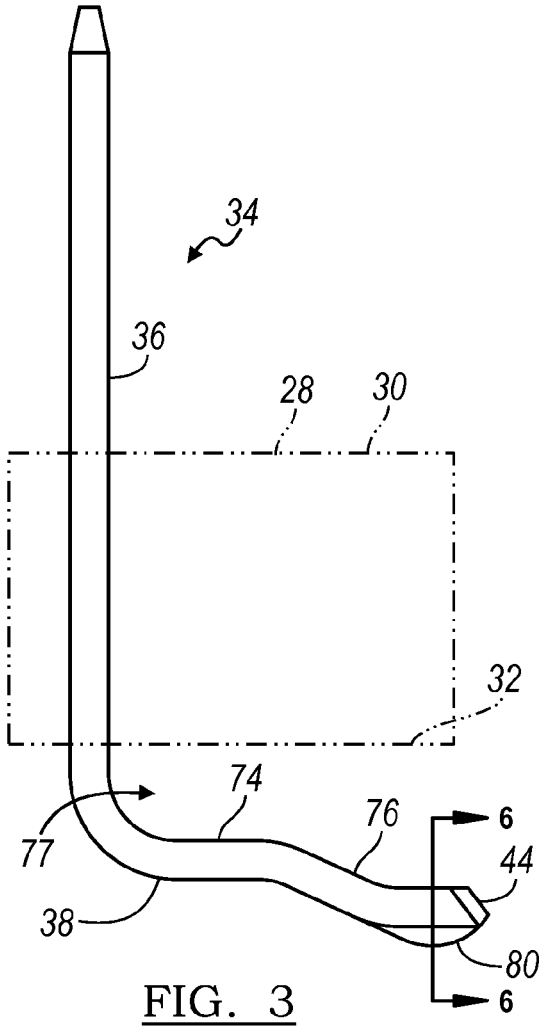
FIG. 3 is an enlarged side view of a terminal of the electrical connector assembly of FIG. 1.
Figure 4:
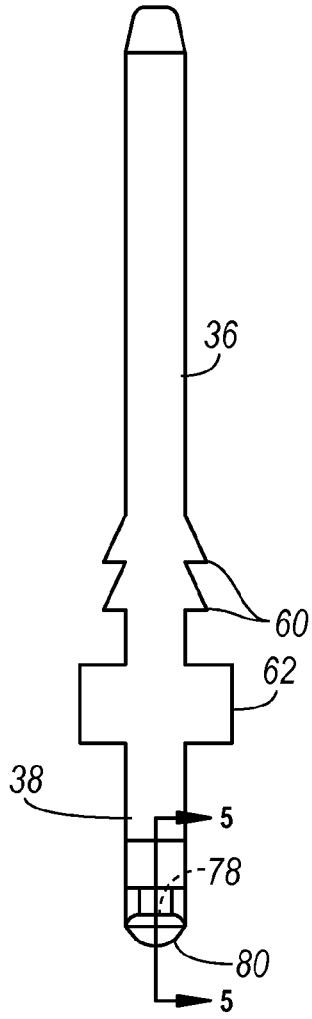
FIG. 4 is a front view of the terminal of FIG. 3.
Figure 5:
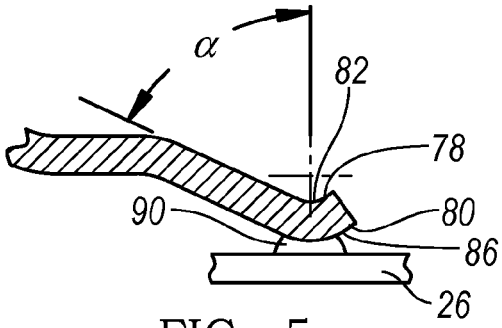
FIG. 5 is a fragmented section view of the terminal of FIG. 4, taken along section line 5-5.
Figure 6:
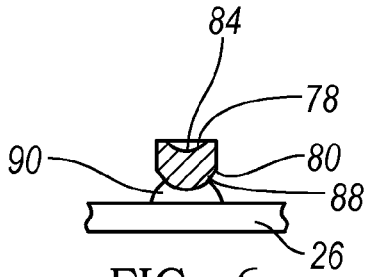
FIG. 6 is a section view of the terminal of FIG. 3, taken along section line 6-6.

Referring to FIGS. 1 and 2, the connector assembly 20 may include surface mount terminals 34 and through-hole terminals 48 of varying size (cross sectional area). The size of a terminal 34, 48 may be selected based on the amount of current passing through an electrical circuit. For example, the connector assembly 20 of the illustrated embodiment includes small surface mount terminals 35, each having a width of 1.2 mm, and rated for a maximum current of ten Amps. The embodiment also includes large surface mount terminals 37, each having a width of 2.8 mm, and rated for a maximum current of fifteen Amps. Through-hole terminals 48 may be used for electrical circuits carrying higher current values, because it may be difficult, or time-consuming to solder large terminals to a circuit board 26. For example, in the illustrated embodiment the through-hole terminals 48, each have a width of 6.3 mm, and are rated for a maximum current of thirty-five Amps.

The legs 38 of the surface mount terminals 34 extend inward between the body 28 and the circuit board 26 to optimize packaging on the board 26. The surface mount terminals 34 project through a first side portion 50 and a second side portion 52 of the body 28. The terminals 34 that project through the first side portion 50 are offset from corresponding terminals 34 projecting through the second side portion 52 to avoid contact between adjacent legs 38 of the terminals 34. By extending the legs 38 inward, rather than outward, the connector assembly 20 creates a smaller "foot-print" or occupies a smaller surface area on the circuit board 26. In the illustrated embodiment, each terminal 34 extends inward such that the tab 44 extends slightly beyond the width of the body 28. The extent to which the tab 44 extends beyond the width of the body 28 may depend on packaging, thermal or manufacturing issues. Other embodiments of the connector assembly 20 employ terminals 34 having tabs 44 that do not extend beyond the width of the body 28; or tabs 44 that extend substantially beyond the body 28 (not shown).

The surface mount terminals 34 are attached to the circuit board 26 using a reflow soldering process according to at least one embodiment. Reflow soldering is a processes known in the art, which includes applying an adhesive mixture of powdered solder and flux (not shown) to the tab 44 for temporarily attaching each terminal 34 to a pad 42 on the circuit board 26. Each tab 44 is then heated until the adhesive mixture becomes a liquid. An infrared lamp, a soldering iron, or a hot air pencil may be used to heat the tabs 44. The liquid solder cools to form an electrical connection (or solder joint) between each tab 44 and pad 42.

The connector assembly 20 includes a series of notches 54 formed into outer peripheral surfaces of the body 28 for facilitating reflow soldering according to at least one embodiment. Each notch 54 extends between the first surface 30 and the second surface 32. Each tab 44 of the surface mount terminals 34 may be aligned with one of the notches 54. As illustrated in FIG. 2, the tabs 44 are longitudinally aligned with the notches 54, such that each tab 44 is oriented directly below a notch 54. This alignment allows an infrared lamp 192 (shown in FIG. 9) to project an infrared signal through the notch 54 to contact the tab 44. The notches 54 may also allow for automating the reflow soldering process. Other embodiments of the connector assembly 20 include tabs 44 that extend beyond the width of the body 28 (not shown). Such embodiments do not include notches 54 in the body 28, because the tabs 44 are already accessible for soldering.

The connector assembly 20 includes supports 56 for resting upon the circuit board 26. The supports 56 extend from the second surface 32 at the ends of the body 28. The through-hole terminals 48 may extend through the supports 56. The connector assembly 20 also includes posts 58 extending from an intermediate portion of the body 28 for resting upon the circuit board 26. The supports 56 and posts 58 support the connector assembly 20 and limit any load transmitted to the electrical connection between the tabs 44 and the circuit board 26.

FIGS. 3-6 illustrate enlarged views of one of the surface mount terminals 34. In one embodiment, the terminal 34 is configured to be inserted into the body 28. The terminal 34 includes barbs 60 that extend from an intermediate portion of terminal 34, between the blade 36 and the leg 38. The barbs 60 engage features (not shown) within the body 28 for retaining the terminal 34. The terminal 34 also includes a stop 62 for limiting an insertion depth of the terminal 34 into the body 28. Other embodiments of the connector assembly 20 mold the body 28 over the surface mount terminals 34, which may eliminate the barbs 60 and the stop 62 (not shown).

The leg 38 includes a first segment 74 and a second segment 76. The first segment 74 extends perpendicularly from the blade 36 between the body 28 and the circuit board 26. The spacing between the first segment 74 and the second surface 32 of the body 28 defines an air gap 77 for facilitating heat dissipation from the leg 38. The second segment 76 extends from the first segment 74 and away from the body 28 at an angle $\alpha$. The tab 44 is formed on the second segment 76 at a distal end of the leg 38.

For example, in one embodiment of the connector assembly 20, the leg 38 of a small surface mount terminal 35 is formed with a profile having an overall length of 8.16 mm. The first segment 74 is approximately 4.0 mm in length, and the second segment 76 extends at an angle $\alpha$ of approximately sixty two degrees.

Prior art surface mount terminals are often formed with linear leg profiles that extended at obtuse angles from the corresponding blade (not shown). Such prior art terminals are prone to inadvertent electrical contact between the terminal leg and the circuit board, especially in high voltage conditions. The perpendicular orientation of the first segment 74 relative to the blade 36 increases the spacing between the leg 38 and the circuit board 26, as compared to the prior art, and therefore limits inadvertent electrical contact.

The geometry of the tab 44 facilitates a strong electrical connection between the terminal 34 and the circuit board 26. The tab 44 is formed in a generally spheroid shape with a concave recess 78 opposite a convex surface 80. The concave recess 78 is defined by an inner lengthwise radius 82 and an inner transverse radius 84. The convex surface 80 is defined by an outer lengthwise radius 86 and an outer transverse radius 88.

For example, in one embodiment of the connector assembly 20, the small surface mount terminal 35 is formed with a concave recess 78 having an inner lengthwise radius 82 of 0.9 mm, and an inner transverse radius 84 of 0.4 mm. The convex surface 80 is formed with an outer lengthwise radius 86 of 1.50 mm, and an outer transverse radius 88 of 0.40 mm.

The convex surface 80 of the tab 44 increases the surface area of the electrical connection with the circuit board 26. During the solder reflow process, surface tension present in liquid solder 90 results in a normal force acting against the tab 44. Prior art flat tabs (not shown) tend to deform away from a circuit board under such conditions, resulting in a poor electrical connection. Other prior art tabs (not shown) include an aperture formed through the tab to relieve surface tension. The spheroid shape of the tab allows the solder 90 to draw upwards about the convex surface 80 as the solder 90 solidifies. The drawing of the solder increases the overall surface area of the electrical connection and relieves surface tension without requiring any apertures being formed through the tab 44.

The spheroid shape of the tab 44 improves the efficiency of the reflow soldering process. Infrared signals may reflect away from the tab 44 during soldering. However the spheroid shape allows for some infrared signals that are initially reflected from the tab 44 to be absorbed within the concave recess 78 of the tab 44.

The concave recess 78 formed in the tab 44 facilitates electrical testing of the connector assembly 20. Measurement devices (e.g. voltmeters) include test probes for contacting different locations of a circuit for taking electrical measurements. The concave recess 78 provides a convenient location for capturing a test probe for taking such a measurement.

The terminal 34 of at least one embodiment is formed by stamping an elongate strip of a conductive material, such as a copper alloy. The terminals 34 are then coated, for example with nickel and tin plating, to reduce corrosion of the terminal 34. A secondary operation may be used to form the spheroid shape of the tab 44 by coining the edges of the tab 44. This coining process tends to roll the plating over any exposed copper which minimizes corrosion. Additionally, the terminal 34 is locally thinned at tab 44, which reduces the thermal resistance of the area to be soldered. The leg 38 profile, which includes the first segment 74 and the second segment 76, may be formed by a bending operation before the terminal 34 is inserted into the body 28. Alternatively, the profile of the leg 38 may be formed after terminal 34 is inserted into the body 28.

Figure 7:
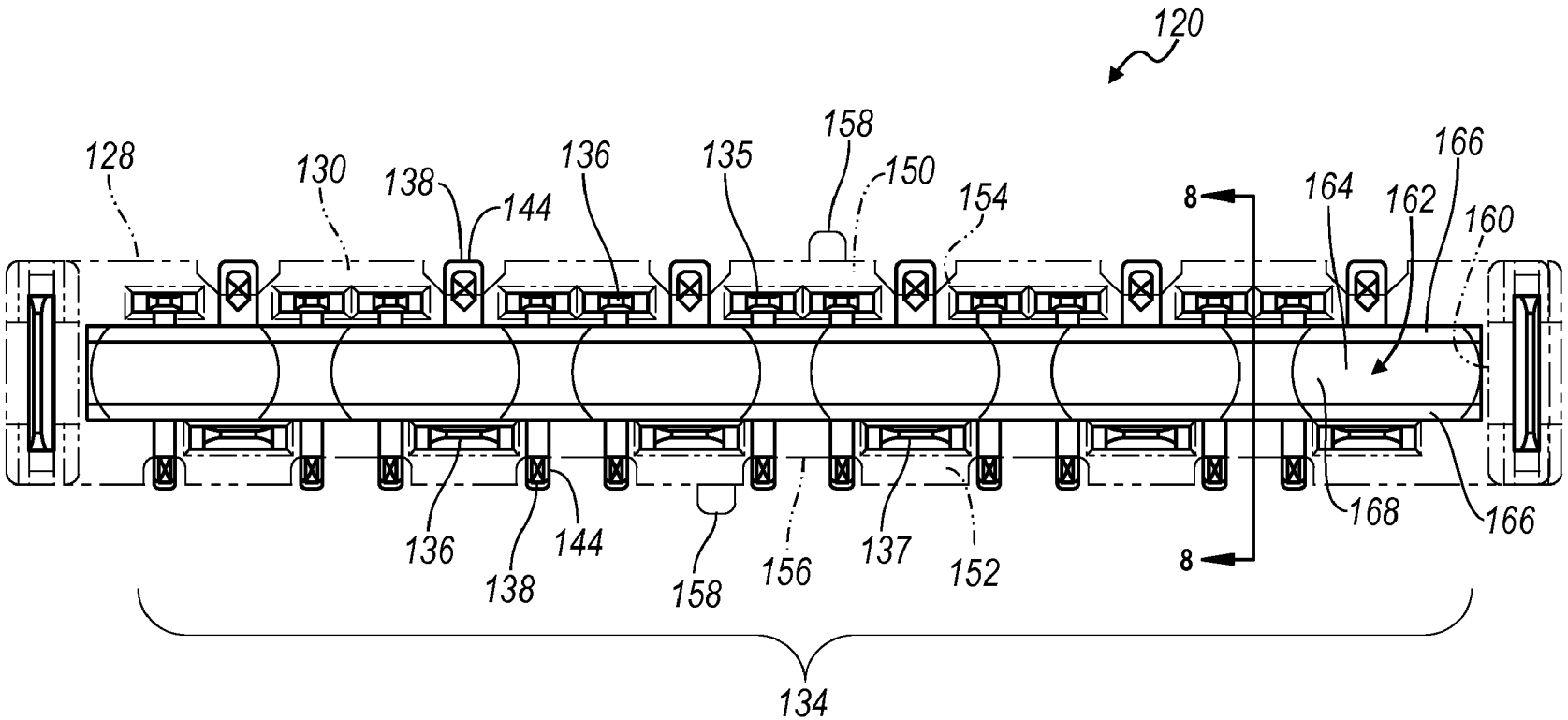
FIG. 7 is a top plan view of the electrical connector assembly according to another embodiment.
Figure 8:
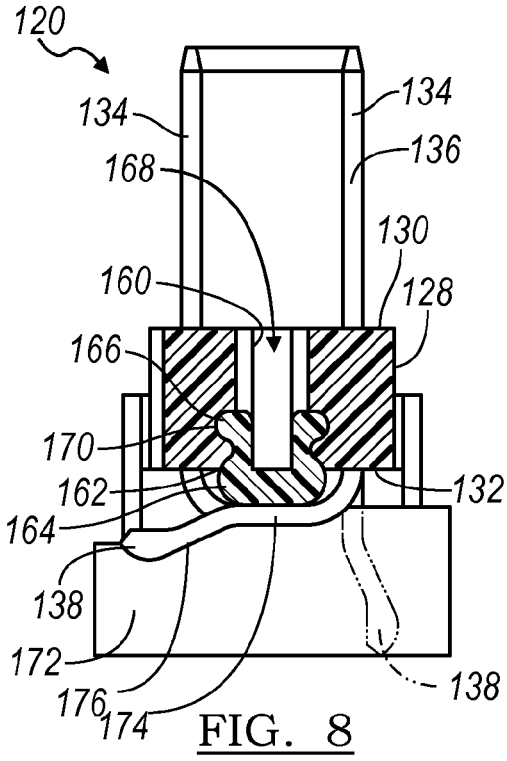
FIG. 8 is a schematic section view of the electrical connector assembly of FIG. 7 taken along line 8-8, and illustrated in a terminal forming position.
Figure 9:
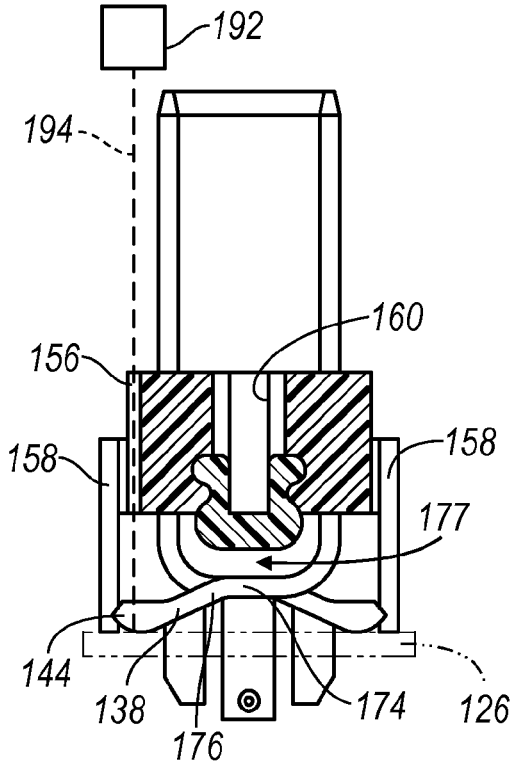
FIG. 9 is a schematic section view of the electrical connector assembly of FIG. 8, illustrated in a terminal soldering position.

With reference to FIGS. 7-9, an electrical connector assembly is illustrated in accordance with another embodiment and is generally referenced by numeral 120. The connector assembly 120 connects to a circuit board 126. The connector assembly 120 includes a body 128 with a first surface 130 and an opposing second surface 132. The connector assembly 120 includes surface mount terminals 134 projecting through the body 128. The terminals 134 include a blade 136 and a leg 138 extending from the first surface 130 and second surface 132 respectively. The leg 138 includes a tab 144 formed at a distal end. The terminals 134 are oriented such that small surface mount terminals 135 project through a first side portion 150 of the body 128, and large surface mount terminals 137 project through a second side portion 152 of the body 128.

The connector assembly 120 may include first notches 154 and second notches 156 formed into outer peripheral surfaces of the body 128 for facilitating reflow soldering. The first notches 154 are formed adjacent to the first side portion 150 and extend between the first surface 130 and the second surface 132. Each first notch 154 is aligned with a tab 144 of a large surface mount terminal 137. The second notches 156 are formed adjacent to the second side portion 152 and extend between the first surface 130 and the second surface 132. As illustrated in FIG. 7, a single second notch 156 may be aligned with the tabs 144 formed on two adjacent small surface mount terminals 135.

The connector assembly 120 is not symmetrical, and may include orientation features ("poke-yoke") for assembly aids. For example, if the connector assembly 120 were rotated one hundred-eighty degrees about a longitudinal axis, the terminals 134 may not align with the corresponding pads (not shown) of the circuit board 126. The connector assembly 120 includes posts 158 for supporting the assembly 120 against any longitudinal loading. In one embodiment of the connector assembly 120, one of the posts 158 is longer than the other and extends into an aperture formed through the circuit board 126 (not shown). Such a feature acts as a "poke-yoke" and facilitates proper orientation of the connector assembly 120 to the board 126.

The connector assembly 120 may include features for dissipating heat from the terminals 134. Excess heat at the terminals could damage the electrical connection between the terminal 134 and the circuit board 126. The connector assembly 120 includes a series of slots 160 formed through a central portion of the body 128 that extend along the length of the body 128. The slots 160 project between the first surface 130 and second surface 132. The connector assembly 120 includes a heat sink core 162 adapted to attach to the body 128 for dissipating heat from the terminals 134. The core 162 is formed of a thermally conducting and electrically insulating material. The core 162 includes an elongate base 164 with a pair of projections 166 that extend longitudinally from the base 164. The projections 166 attach to the body 128 within the slots 160. The projections 166 are spaced from each other to form a channel 168. The body 128 includes a ridge 170 extending lengthwise within each slot 160 for engaging the projections 166.

FIGS. 8-11 illustrate a method for connecting the connector assembly 120 to the circuit board 126. The core 162 is adapted to translate longitudinally with respect to the body and provide different functionality.

FIG. 8 illustrates forming a generally perpendicular terminal leg 138 profile after each terminal 134 is attached to the body 128. In one embodiment, the terminal 134 is initially formed in an elongate shape with a leg 138 that is substantially in-line with the blade 136. The core 162 is attached to the body 128, such that the projections 166 extend into the slots 160, and the base 164 is disposed about the second surface 132. The core 162 serves as a forming mandrel, while a forming tool 172 translates toward the body 128 to form the profile of the leg 138. The forming tool 172 deforms the leg 138, both plastically and elastically about the core 162. Once the forming tool 172 is removed, the leg 138 elastically deforms back to the leg 138 profile position illustrated in FIG. 9. Other embodiments of the connector assembly 120 contemplate forming a profile in the legs 138 of the surface mount terminals 134 before the terminal 134 is attached to the body 128.

The terminal legs 138 each include a first segment 174 and a second segment 176. The first segment 174 extends perpendicularly from the blade 136 between the body 128 and the circuit board 126. The spacing between the first segment 174 and the second surface 132 of the body 128 defines an air gap 177 for facilitating heat dissipation from the leg 138. The second segment 176 extends from the first segment 174 and away from the body 128. The tab 144 is formed on the second segment 176 at a distal end of the leg 138.

Figure 10:
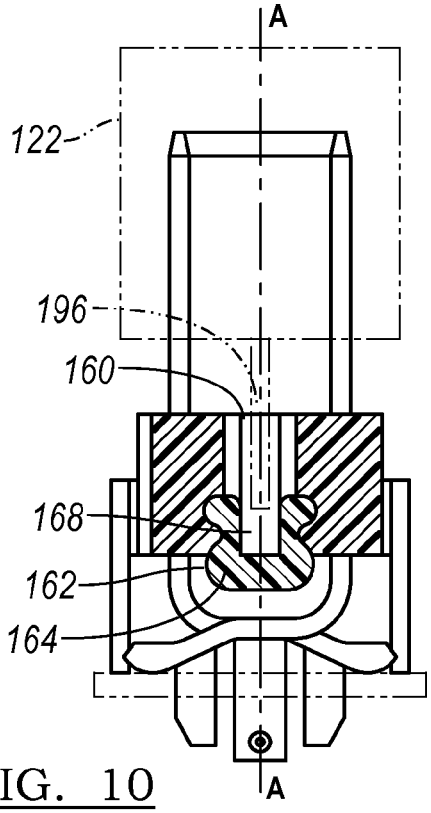
FIG. 10 is a schematic section view of the electrical connector assembly of FIG. 8, illustrated in a core attached position.
Figure 11:
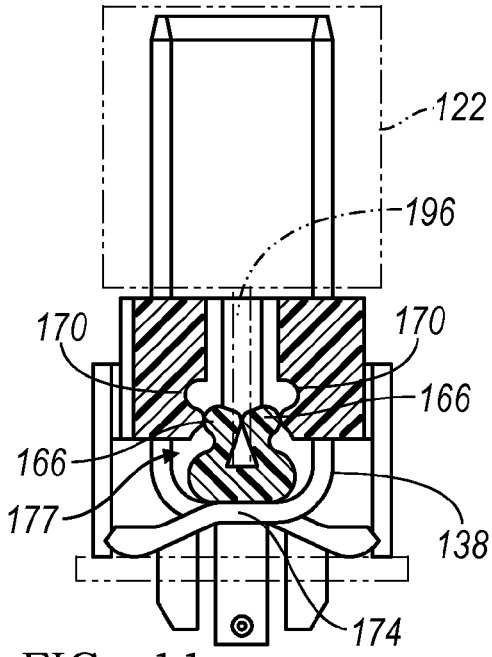
FIG. 11 is a schematic section view of the electrical connector assembly of FIG. 8, illustrated in a core detached position.

Referring to FIGS. 9-11, the core 162 is configured to translate longitudinally from an initial position where the core 162 is attached to the body 128 (FIG. 9), to a final position where the core 162 is detached from the body 128 and in contact with each leg 138 (FIG. 11).

Referring to FIG. 9, the surface mount terminals 134 may be attached to the circuit board 126 using a reflow soldering process. The tabs 144 are longitudinally aligned with the notches 156 such that each tab 144 is oriented directly below a notch 156. This alignment allows an infrared lamp 192 to project an infrared signal 194 through the notch 156 to contact the tab 144 for melting solder disposed on the tab 144 and forming an electrical connection between the terminal 134 and the circuit board 126.

The temperature of the tab 144 is an important parameter of the reflow soldering process to control the melting and cooling of the solder. Since the core 162 is formed of a thermally conductive material, the core 162 is attached to the body 128 and spaced away from the legs 138 during soldering. This spacing prevents the core 162 from dissipating heat from the terminals 134 by conduction during the reflow soldering process.

Referring to FIGS. 10 and 11, the core 162 is detached from the body 128, after the reflow soldering process is completed. The core 162 is adapted for translating away from the second surface 132 of the body 128 when the core 162 is subjected to a longitudinal load. The in-line connector 122 includes a protrusion 196 that extends from the connector 122 along the longitudinal axis of insertion A-A. The protrusion 196 is aligned with one of the slots 160, and extends through the slot 160 to contact the core 162. As the in-line connector 122 translates toward the connector assembly 20, the protrusion 196 extends into the channel 168 of the core 162 and contacts the base 164. The core 162 is formed of a semi-flexible material, such that as the protrusion 196 applies a load to the base 164, the projections 166 of the core 162 flex inward and disengage the ridge 170. The length of the protrusion 196 is sized to translate the core 162 into contact with the first segment 174 of each terminal leg 138. Other embodiments of the connector assembly 120 contemplate multiple protrusions 196 extending from the in-line connector 122.

It is difficult to install the core 162 between the body 128 and the terminals 134 after the tabs 144 are soldered to the circuit board 126. By detaching the core 162 from the body 128 using the in-line connector 122, the core 162 is positioned in contact with the terminals 134 without adding any additional steps to the assembly process.

Although the core 162 is detached from the body 128, the core 162 is captured between the body 128 and the terminals 134. The projections 166 remain in contact with an internal portion of the slot 160, which prevents the core 162 from sliding with respect to the length of the body 128.

With reference to FIG. 11, the core 162 dissipates heat from the terminals 134. During electrical operation of the circuit board 126, heat is transferred from the terminals 134 to the core 162. The core 162 transfers heat by conduction to other terminals 134. The core 162 also acts as a heat sink and transfers heat by convection to the air gap 177 (fluid medium). Additionally, the core 162 is formed of an electrically insulating material, which prevents the core 162 from conducting electrical signals between the different terminals 134.

While embodiments of the present invention are described above, it is not intended that these embodiments describe all possible forms of the present invention. Rather, the words used in the specification are words of description rather than limitation, and various changes may be made without departing from the spirit and scope of the present invention. Additionally, the features of various implementing embodiments may be combined to form further embodiments of the present invention.

What is claimed is:

1. A connector assembly comprising:

a body extending along a length with a longitudinal height defined by a first surface and an opposing second surface, wherein the body has at least one notch formed into an outer peripheral surface and extending between the first and second surfaces;

at least one terminal projecting through the body, the terminal having a blade extending from the first surface for electrically connecting with a mating connector, the terminal also having a leg extending from the second surface; and a tab having a convex surface formed at a distal end of the leg without any apertures formed therethrough, the convex surface being adapted for electrically connecting with a mounting surface of an electronic component upon receipt of a predetermined signal, wherein the tab is aligned with the notch for receiving the predetermined signal through the notch.

2. The connector assembly of claim 1 wherein the tab has a concave recess formed therein and oriented opposite the convex surface for receiving the predetermined signal, the tab being adapted for absorbing heat generated by the predetermined signal for melting an adhesive mixture disposed on the tab for electrically connecting the tab to the mounting surface.

3. The connector assembly of claim 1 wherein the tab is formed into a spheroid shape.

4. The connector assembly of claim 1 wherein the body has a series of notches formed therein and wherein at least one tab is aligned with each notch.

5. The connector assembly of claim 1 wherein the leg further comprises:

a first segment extending perpendicularly and inward from the blade, the first segment being spaced from the second surface for facilitating heat dissipation from the terminal; and a second segment extending from the first segment and away from the body, the second segment having the tab formed thereon.

6. The connector assembly of claim 5 wherein the terminal comprises a plurality of terminals projecting through the body, the legs of the terminals collectively defining a lengthwise extending air gap between the body and the first segment of each terminal.

7. The connector assembly of claim 6 further comprising a core disposed about a central portion of the body and within the air gap, the core being adapted for detaching from the body to engage the leg of each terminal when subjected to a longitudinal load.

8. A connector assembly comprising:

a body extending along a length with a longitudinal height defined by a first surface and an opposing second surface;

at least one terminal projecting through the body, the terminal having a blade extending from the first surface for electrically connecting with a mating connector attached to a wiring harness, the terminal also having a leg extending from the second surface;

a tab formed at a distal end of the leg with a convex surface formed thereon for electrically connecting with a mounting surface of an electronic component upon receipt of a predetermined signal; and a core attached to the body about the second surface and oriented in a first position spaced from the terminal, the core being adapted for detaching from the body to a second position engaging the terminal, when subjected to a longitudinal load.

9. The connector assembly of claim 8 wherein the core is formed of an electrically insulating and thermally conducting material for dissipating heat from the terminal.

10. The connector assembly of claim 8 wherein the body has a slot formed through a central portion of the body between the first and second surfaces.

11. The connector assembly of claim 10 wherein the core further comprises:

an elongate base disposed about the second surface of the body; and a pair of projections extending longitudinally from the base and spaced from each other to form a channel therebetween, the projections being adapted for attaching to the body within the slot in the first position and detaching from the body when the core is subjected to a transverse load applied into the channel.

12. The connector assembly of claim 8 wherein the terminal comprises a plurality of terminals projecting through the body, the legs of the terminals collectively defining a lengthwise extending air gap between the body and the leg of each terminal for receiving the core.

13. The connector assembly of claim 8 wherein the tab is formed into a spheroid shape.

14. The connector assembly of claim 8 wherein the body has at least one notch formed into an outer peripheral surface and extending between the first and second surfaces, and wherein the tab is aligned with the notch for receiving the predetermined signal through the notch.

15. A method for electrically connecting a connector assembly to a surface of an electronic component, the method comprising:

providing a body with at least one terminal projecting therethrough, the terminal having a blade and a leg each extending from opposing surfaces of the body;

attaching a thermally conductive core to the body such that the core is spaced from the leg;

heating a distal portion of each leg for electrically connecting the leg to a mounting surface of an electronic component;

detaching the core from the body; and engaging the core with the leg.

16. The method of claim 15 further comprising attaching the core about a slot formed through a central portion of the body.

17. The method of claim 16 further comprising:

providing a mating connector having a female terminal sized for receiving each blade, the mating connector having a protrusion extending longitudinally from a central portion of the mating connector;

translating the mating connector toward the connector assembly; and extending the protrusion into the slot to contact the core and translate the core from a first position adjacent the body to a second position adjacent the terminal.

18. The method of claim 15 further comprising:

bending the leg over the core to form a first leg segment; and releasing the leg to form an air gap between the first leg segment and the body.

19. The method of claim 15 further comprising transmitting an infrared signal through a notch formed into an outer peripheral surface of the body to contact a tab formed on the distal end of the leg for melting an adhesive mixture disposed on the tab.

20. A connector assembly comprising:

a body extending along a length with a longitudinal height defined by a first surface and an opposing second surface, the body having at least one notch formed into an outer peripheral surface and extending between the first and second surfaces;

at least one terminal projecting through the body, the terminal having a blade extending from the first surface for electrically connecting with a mating connector, the terminal also having a leg extending from the second surface; and a tab formed at a distal end of the leg and aligned with the notch, the tab being adapted for electrically connecting with a mounting surface of an electronic component upon receipt of a predetermined signal through the notch.

* * * * *